US008181699B2

(12) United States Patent
Zavesky et al.

(10) Patent No.: US 8,181,699 B2
(45) Date of Patent: May 22, 2012

(54) AUXILIARY CONDUIT CUTTING APPARATUS

(75) Inventors: Anthony C. Zavesky, Houston, TX (US); Steven G. Blair, Tomball, TX (US); Christopher W. Guidry, Spring, TX (US); Steve Rosenblatt, Houston, TX (US)

(73) Assignee: Baker Hughes Incorporated, Houston, TX (US)

( * ) Notice: Subject to any disclaimer, the term of this patent is extended or adjusted under 35 U.S.C. 154(b) by 381 days.

(21) Appl. No.: 12/469,388

(22) Filed: May 20, 2009

(65) Prior Publication Data

US 2010/0294477 A1 Nov. 25, 2010

(51) Int. Cl.
*E21B 43/11* (2006.01)

(52) U.S. Cl. ..... 166/55.3; 166/297; 30/94

(58) Field of Classification Search ..... 166/55, 166/55.1, 55.3, 55.6, 297, 376, 377; 72/112, 72/391; 30/92, 94
See application file for complete search history.

(56) References Cited

U.S. PATENT DOCUMENTS

| | | | | |
|---|---|---|---|---|
| 4,160,478 | A * | 7/1979 | Calhoun et al. | 166/55.1 |
| 4,981,177 | A | 1/1991 | Carmody et al. | |
| 6,789,627 | B2 * | 9/2004 | Leismer | 166/377 |
| 6,997,262 | B2 * | 2/2006 | Palmer et al. | 166/298 |
| 2002/0162667 | A1 | 11/2002 | Ingram et al. | |
| 2004/0089451 | A1 | 5/2004 | Palmer et al. | |
| 2005/0133227 | A1 | 6/2005 | Wills | |

FOREIGN PATENT DOCUMENTS

| | | | |
|---|---|---|---|
| WO | 0188330 | A1 | 11/2001 |
| WO | 2008085062 | A1 | 7/2008 |

* cited by examiner

*Primary Examiner* — David Bagnell
*Assistant Examiner* — Kipp Wallace
(74) *Attorney, Agent, or Firm* — Steve Rosenblatt

(57) ABSTRACT

A cutting assembly for external conduits on a tubing string features a breakaway in the string that can be severed with a tensile force. Preferably each external conduit is run through a cutter housing. Upon severing of the string and applying a pickup force, a tension is applied to each external conduit since the severing of the string happens above all the cutter housings. Each housing cuts at least one conduit and the upper portion of the string brings with it the upper portion of the external conduit while the lower portions of each cut external conduit are retained in the cutter housings that remain downhole below the breakaway. In that manner there are no loose external conduit ends to interfere with and/or disturb subsequent fishing or other wellbore operations.

22 Claims, 7 Drawing Sheets

AUXILIARY CONDUIT CUTTING APPARATUS

FIELD OF THE INVENTION

The field of the invention is cutting auxiliary conduits associated with a bottom hole assembly when the string supporting the bottom hole assembly is separated and pulled out of the ground.

BACKGROUND OF THE INVENTION

In many applications in oil or gas wells, a main tubular conduit, such as production tubing, is run into the wellbore with a bottom hole assembly attached. The bottom hole assembly may have a wireline, control line, vent line, or other such longitudinal member(s) attached to it. Typically, these wireline, control line, vent line, or other such longitudinal member(s) will be run externally to the production tubing. Such longitudinal members will be referred to as external longitudinal members herein. Often, there may be several such external longitudinal members run into the wellbore along with, and external to, the production tubing or other main tubular conduit.

In some circumstances, it becomes necessary to cut or sever the main tubular conduit at a point downhole, and to pull the tubular conduit back out of the hole, leaving the severed lower portion of tubular conduit, and the bottom hole assembly attached thereto, in the wellbore. This also necessitates the cutting of the external longitudinal members, preferably without a separate operation for running specialized cutting equipment into the wellbore. It is also desirable to be able to cut the wireline, control line, vent line, or other such longitudinal member(s) somewhere downhole as close as possible to the point at which the tubular conduit is cut, to salvage as much as possible of the external longitudinal member and keep the wellbore as open as possible.

A prior design described in U.S. Pat. No. 6,997,262 provided a method and apparatus for severing one or more external longitudinal members, with a cutting tool attached to the main tubular conduit, above the bottom hole assembly. The cutting tool consisted of a cutter body which was clamped in place on the external surface of the main tubular conduit, such as by capturing the cutter body between two couplers threaded onto the tubular conduit. Inside the cutter body are cutter knives which slide longitudinally relative to the cutter body. These cutter knives are fixedly attached to the external longitudinal member, such as by being clamped thereto. The external longitudinal member or members are routed through the cutter body so as to be exposed to the cutting edge of the knife or knives. If there are several knives, they can be oriented facing each other, and the external longitudinal member or members are routed between the cutting edges on the cutter knives. A surface on each cutter knife abuts an actuating surface on the cutter body, with this actuating surface sloping downwardly and transversely to the longitudinal axis of the cutting tool. If there are several cutter knives, there can be a single conical actuating surface, or several actuating surfaces.

If it became necessary to sever the main tubular conduit and retrieve the upper portion, this operation was first accomplished below the cutting tool. The upper portion of the tubular conduit is then pulled upwardly, or uphole, to retrieve it from the well.

After the tubular conduit is severed, pulling upwardly on the tubular conduit will also lift the cutter body upwardly, or in an uphole direction. At the same time, the external longitudinal member to which the cutter knives are attached is still attached to the bottom hole assembly, thereby holding the cutter knives in place longitudinally in the well bore. The uphole movement of the cutter body relative to the cutter knives caused the sloping actuating surfaces on the cutter body to engage the abutting surfaces on the cutter knives and forced the cutter knives toward each other, or inwardly. This drove the cutting edges of the cutter knives through the external longitudinal member or members, severing them. This allowed the external longitudinal member or members and the cutting tool to be simultaneously retrieved from the well bore.

As shown in FIG. 1, a preferred embodiment of the apparatus 10 includes generally a cutter body 12, and one or more cutter knives 18,20. The cutter body 12 has a longitudinal bore 14 therethrough, for passage of a tubular conduit TC to which the apparatus 10 of the present invention may be attached. For example, the cutter body 12 can be captured in place longitudinally on the tubular conduit TC by threading of couplers (not shown), as is known in the art, on the ends of the section of tubular conduit TC, above and below the cutter body 12.

The cutter body 12 has a generally longitudinal knife chamber 16 in which the cutter knives 18, 20 are slidably positioned. The cutter knives 18, 20 have clamping bodies 22, 24 near their upper ends. The clamping bodies 22, 24 can be fastened together, as shown better in FIG. 2, to clamp tightly around a longitudinal member, such as a wireline WL, which is positioned externally to the tubular conduit TC. The clamping bodies 22, 24 can be bolted together at mating surfaces 50, as is well known in the art. The bolts and bolt holes are omitted in these views, for the sake of clarity.

The cutter knives 18, 20 have thinner mid-sections 26, 28, which can flex to allow the lower ends of the knives 18, 20 to deflect inwardly, as will be explained below. Cutter blades 30, 32 are mounted on the knives 18, 20 near their lower ends, with the blades 30, 32 having cutting edges 34, 36 facing each other, or facing inwardly. FIG. 3 shows this orientation of the cutting edges 34, 36. Stiffeners 52, 54 can be provided on the cutter knives 18, 20 if required.

As seen in FIGS. 1 through 3, a wireline passage 38 is provided longitudinally through the cutter body 12, as is a vent line passage 40. Similarly, a passage could be provided for a control line or any other kind of external longitudinal member that may be in use next to the tubular conduit TC. These longitudinal member passages, 38 and 40, position the external longitudinal members VL, WL between the cutter knives 18, 20, and specifically between the cutting edges 34, 36. As shown in FIG. 3, one cutting edge 36 can be V-shaped to centralize the vent line VL and the wireline WL between the cutting edges 34, 36.

A set of teeth or serrations 42 can be provided within the wireline passage 38, to facilitate holding the cutter knives 18, 20 in position longitudinally relative to the wireline WL, when the clamping bodies 22, 24 are bolted together. The portion of the wireline passage 38 between the clamping bodies 22, 24 is dimensioned to slightly squeeze the wireline WL, without collapsing it or otherwise damaging it. The vent line passage 40 is dimensioned to allow passage of the vent line VL without squeezing it. As shown in FIG. 2, bolts and bolt holes 44 are provided to bolt together the two halves 12A, 12B of the cutter body 12, in a similar fashion to that contemplated for the clamping bodies 22, 24. Bolting together of the two cutter body halves 12A, 12B facilitates positioning of the cutter knives 18, 20 within the knife chamber 16.

As shown best in FIG. 1, one or more sloping surfaces 46,48 are provided at the lower end of the knife chamber 16, sloping longitudinally and inwardly toward the longitudinal members VL,WL passing through the cutter body 12. The lower ends of the cutter knives 18, 20 abut these sloping surfaces 46, 48. Rather than having two distinct sloping surfaces, a conical sloping surface could be used with a plurality of inwardly facing knives.

The configurations shown in FIGS. 1 and 3 represent the made-up or run-in configuration of the apparatus 10. After the tubular conduit TC and the bottom hole assembly (not shown) are positioned in the wellbore, it may become necessary to sever the tubular conduit TC, the vent line VL, and the wireline WL above the bottom hole assembly and retrieve them from the wellbore. After the tubular conduit TC is severed, by any means known in the art, the upper portion of the tubular conduit TC is pulled upwardly, or in the uphole direction.

As shown in FIG. 4, this lifts the cutter body 12 in the uphole direction. Since the cutter knives 18, 20 are clamped in position longitudinally on the wireline WL, the lower end of which is still attached to the bottom hole assembly, the cutter knives 18, 20 are forced inwardly by the sloping surfaces 46, 48 in the cutter body 12, as the cutter body 12 rises. This forces the cutting edges 34, 36 of the blades 30, 32 toward each other, through the longitudinal members VL, WL, severing them. FIG. 5 shows the overlapping of the cutter blades 30, 32 after the cutter knives 18, 20 have been forced fully inwardly by the sloping surfaces 46, 48. After the severing operation, the upper portions of the external longitudinal members VL, WL can be retrieved from the wellbore.

There were two main issues with the technique described above and the associated FIGS. One issue was the need to run a line cutter into the string to cut it as the preferred technique to sever a portion of the string from the bottom hole assembly (BHA). This added time, cost, and risk to the operation. Apart from this, was that after the string was cut and picked up and the members VL and WL were cut, what remained below the cut location fell into the well and made subsequent fishing operations more difficult, if not impossible, by getting in the way of the retrieving or fishing tools.

The present invention addresses these problem areas in the prior design. It uses a breakaway coupling that comes apart by a tensile force on the string to part the string. Having parted the string, the cutter assembly has the housing and cutter location inverted from the previous design. When the string is parted and is pulled up, what happens is that the external longitudinal conduit(s) are tensioned, pulling the knives into the cutting mode, but hanging on to the lower cut portion of the external longitudinal conduit(s) from just below the cut location to the fixation location in the BHA, so that there is no loose end that can fall into the wellbore and disturb subsequent fishing or other operations. Those skilled in the art will better understand the invention from a review of the preferred embodiment and the associated drawings while recognizing that the full scope of the invention is given by the appended claims.

SUMMARY OF THE INVENTION

A cutting assembly for external conduits on a tubing string features a breakaway in the string that can be severed with a tensile force. Preferably each external conduit is run through a cutter housing. Upon severing of the string and applying a pickup force, tensile force is applied to each external conduit since the severing of the string happens above all the cutter housings. Each housing cuts at least one conduit and the upper portion of the string brings with it the upper portion of the external conduit, while the lower portions of each cut external conduit are retained in the cutter housings that remain downhole below the breakaway. In that manner there are no loose external conduit ends to fall in the wellbore.

DETAILED DESCRIPTION OF THE PREFERRED EMBODIMENT

Figure 1:
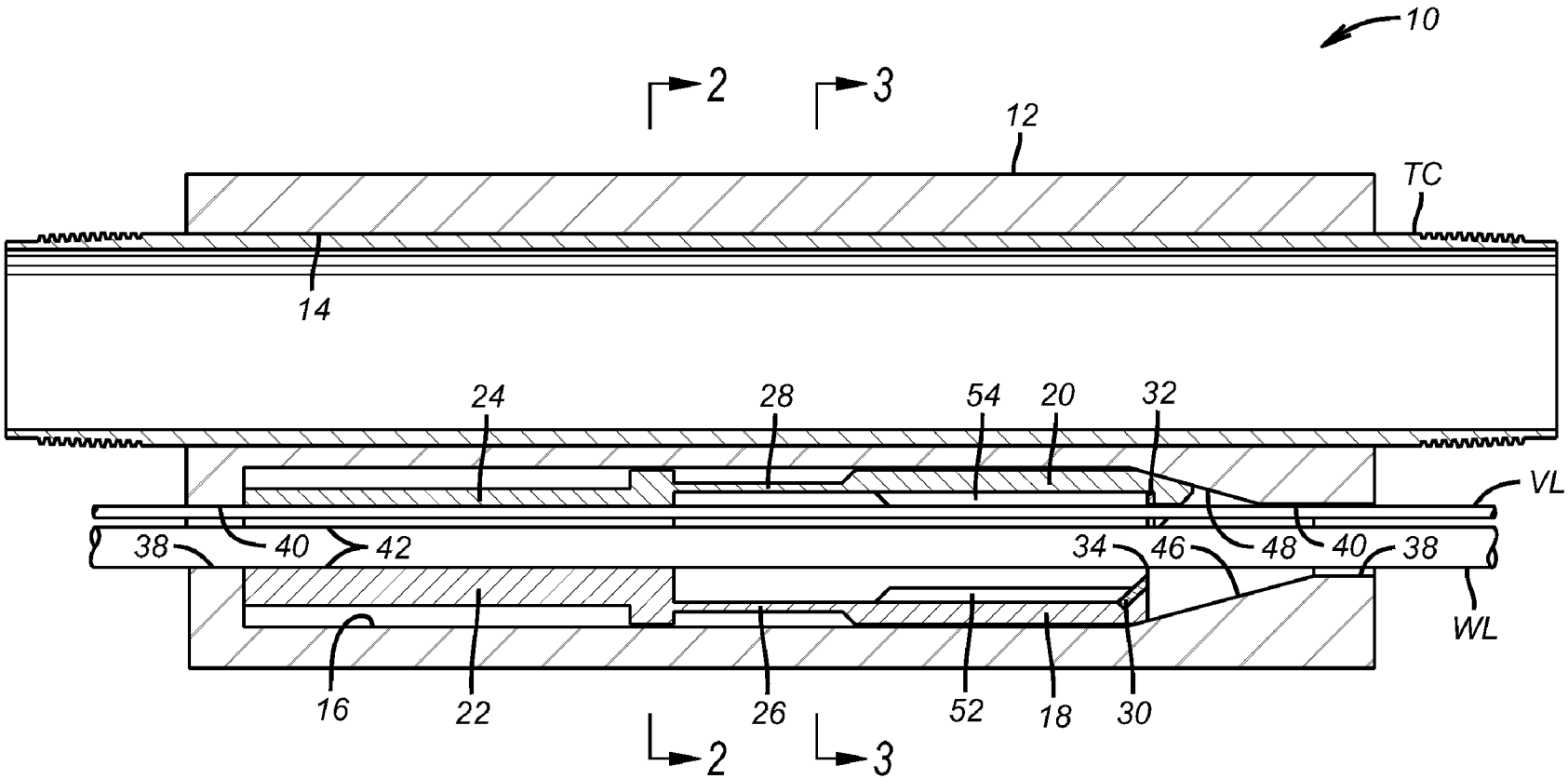
(PRIOR ART) FIG. 1
FIG. 1 is a longitudinal section view of a prior art apparatus (couplers not shown), showing its attachment to a tubular conduit, a vent line, and a wireline.
Figure 3:
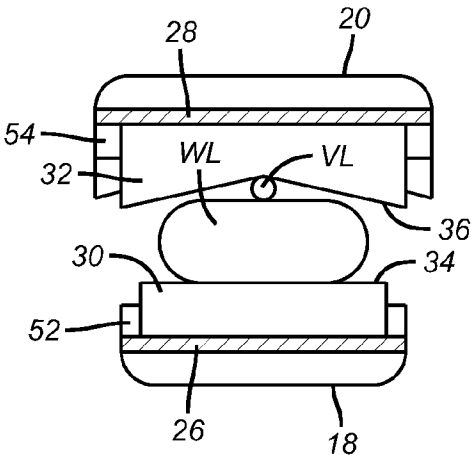
(PRIOR ART) FIG. 3
FIG. 3 is a transverse section view of the apparatus shown in FIG. 1, taken at the line 3-3.
Figure 5:
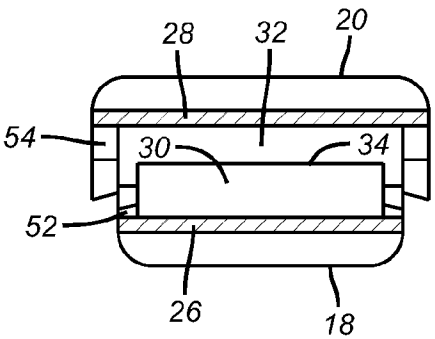
(PRIOR ART) FIG. 5
FIG. 5 is a transverse section view of the apparatus shown in FIG. 4, showing the actuation of the cutter knives.
Figure 2:
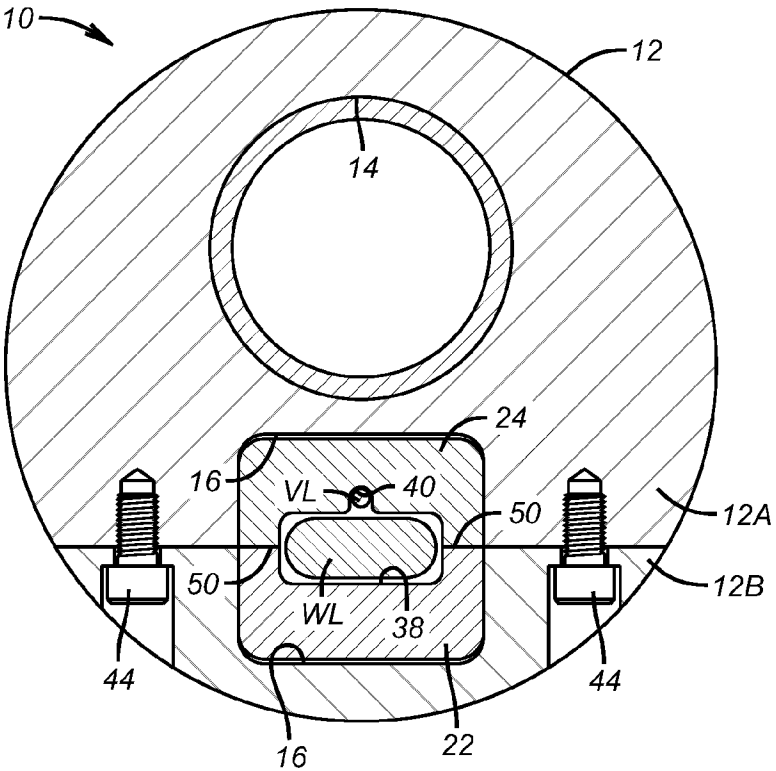
(PRIOR ART) FIG. 2
FIG. 2 is a transverse section view of the apparatus shown in FIG. 1, taken at the line 2-2.
Figure 4:
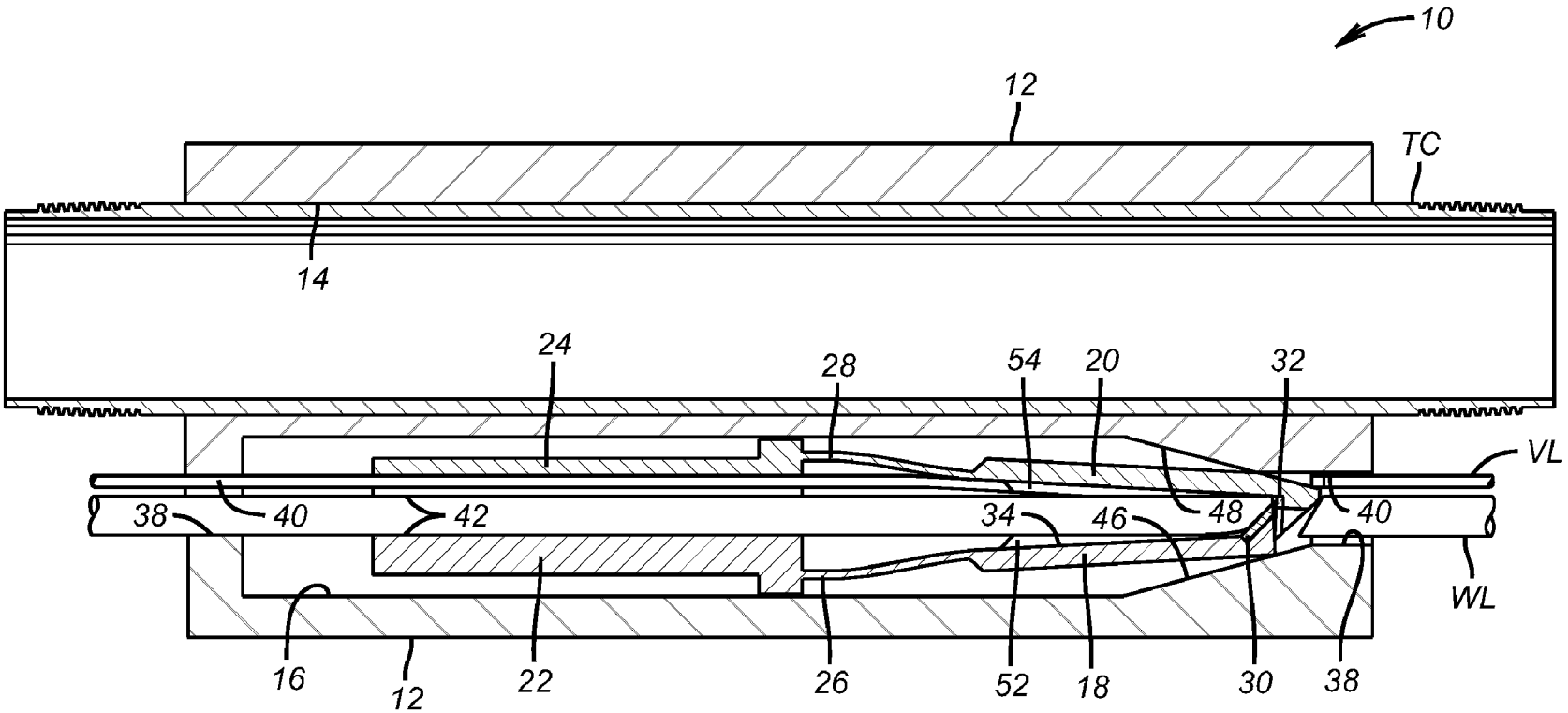
(PRIOR ART) FIG. 4
FIG. 4 is a longitudinal section view of the apparatus showing the actuation of the cutter knives.
Figure 6:
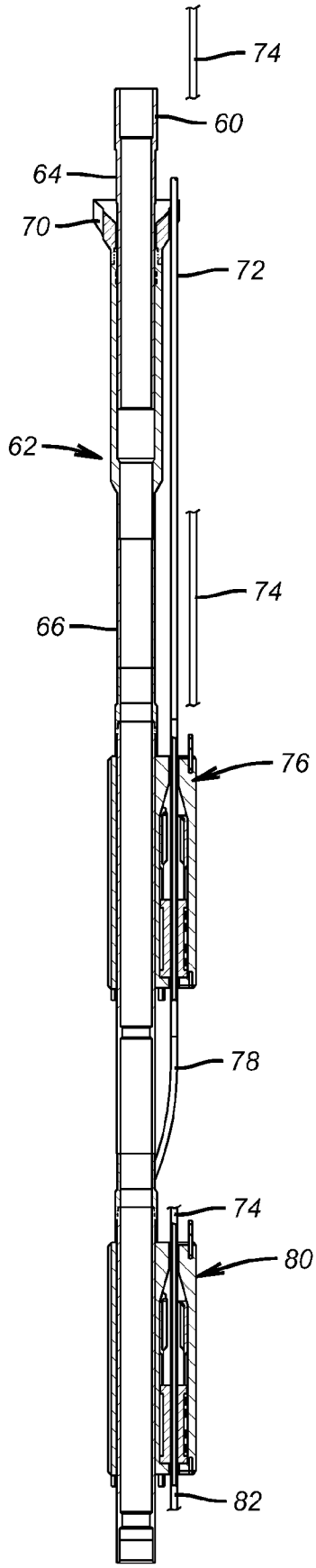
FIG. 6 is a view of the present invention shown in a run-in position with multiple cutters for external conduits or lines.

Referring to FIG. 6, a string 60 on a part of which is shown and those skilled in the art will know extends to the surface of a wellbore features a schematically illustrated breakaway 62 that has an upper component 64 and a sealingly nested lower component 66. As used herein, "breakaway" includes any feature of the string designed to come apart when force is applied as well as the use of external tools that accomplish the same result of separation. They are releasably secured together preferably by one or more shear fastener(s) 68. The invention contemplates a variety of designs with the ultimate objective of separation in the string 60. Accordingly, the separation can be accomplished with an axial force or rotation or combinations of movements such as when a j-slot assembly is used. Alternatively there can be a ball seat on a sleeve that accepts a dropped object to allow pressuring up to accomplish the separation by, for example, breaking a shear fastener in the breakaway 62. Using fluid pressure for the separation can make the assembly serviceable in wells that have some deviation or are non-vertical. In an application using an electric submersible pump (ESP) there is generally little deviation and a breakaway 62 that separates by a pulling force will generally be workable. More deviated applications will likely require a way to hydraulically disconnect the breakaway 62 in the manner discussed above or equivalent techniques.

Figure 9:
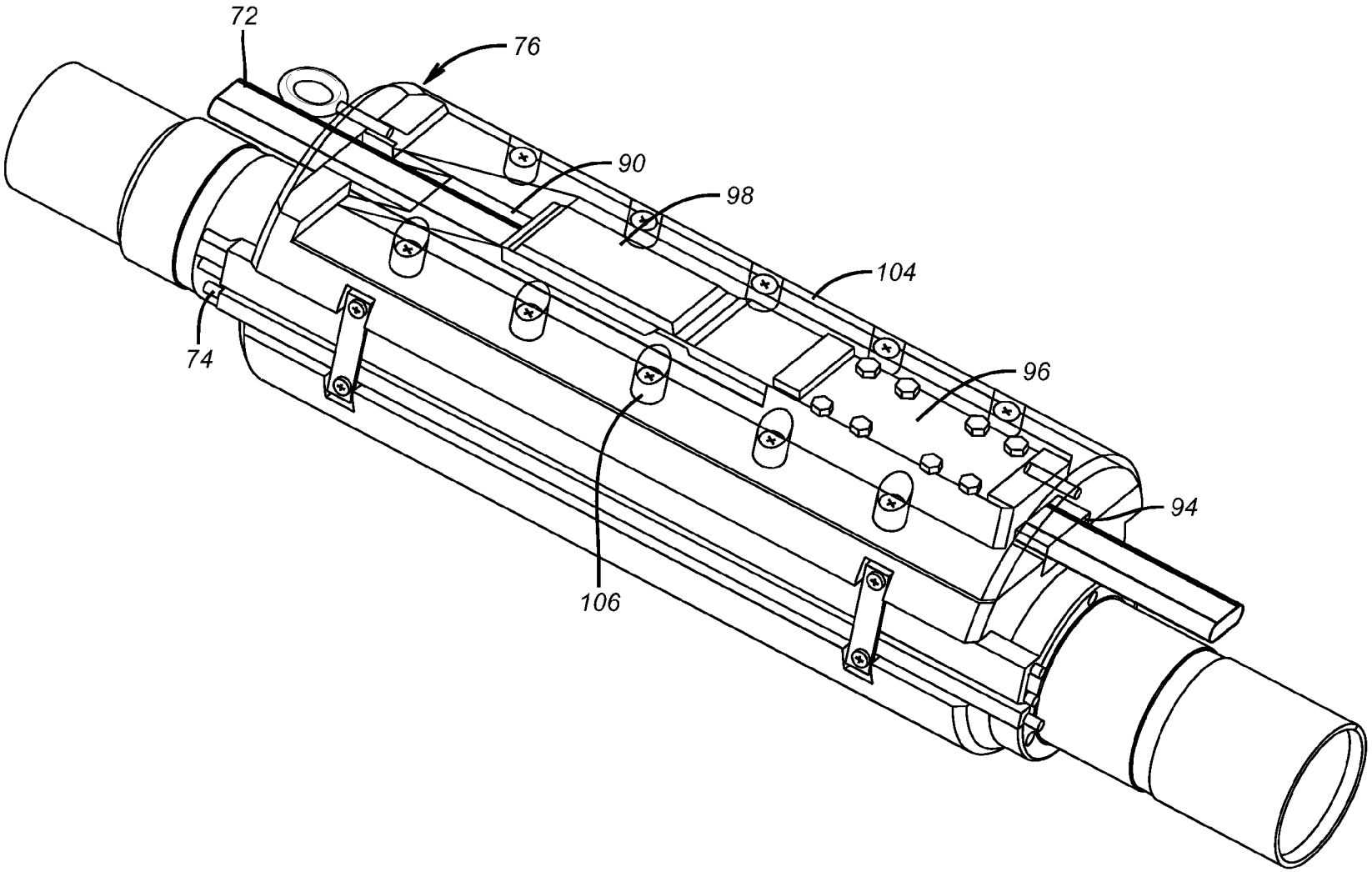
FIG. 9 is a perspective of a cutter housing showing a line going to another cutter housing passing through and bypassing the knife assembly.

The upper component 64 has a guide 70 through which an external conduit or conduits can be guided. In FIG. 6 conduits 72 and 74 are shown, but to make the FIG. 6 clear, only a part of conduit 74 is illustrated. Conduit 72 extends into a cutter housing 76, it then continues at lower end 78 and bypasses cutter housing 80 to extend to the BHA, which is not shown. Conduit 74 bypasses cutter housing 76 as best shown in FIG. 9, and continues to cutter housing 80. It then has a lower end 82 that continues to the BHA which is not shown. To list a few possibilities, the term "conduit" as used herein can include a variety of structures such as fiber optic cable, power and signal lines, or control lines that covey fluid pressure. While individual conduits are shown associated with a cutter housing 76 and 80, those skilled in the art will appreciate that a single housing can cut one or more conduits.

Figure 7:
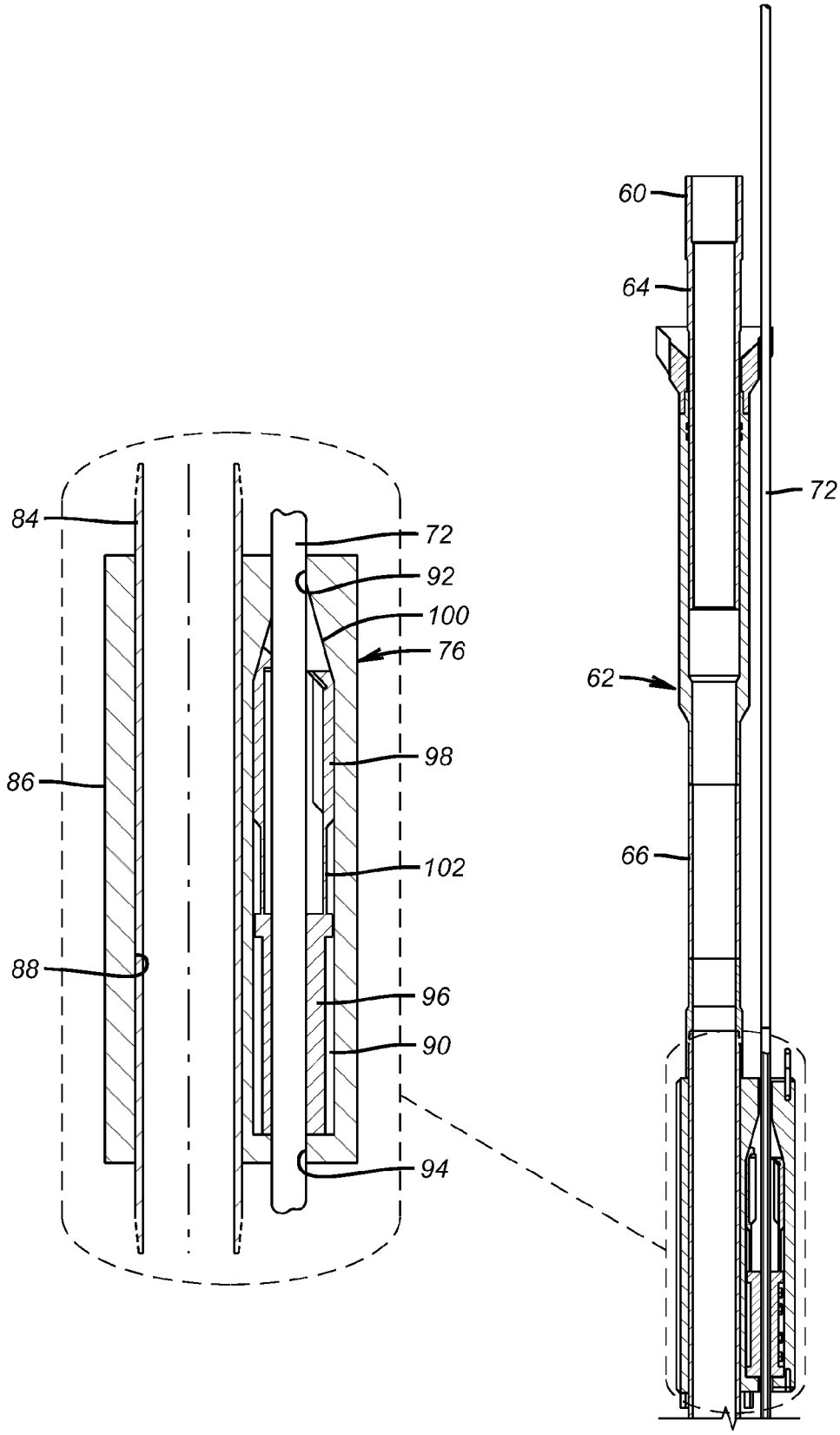
FIG. 7 is the detailed view of FIG. 6 showing a close-up view of a cutter assembly.
Figure 8:
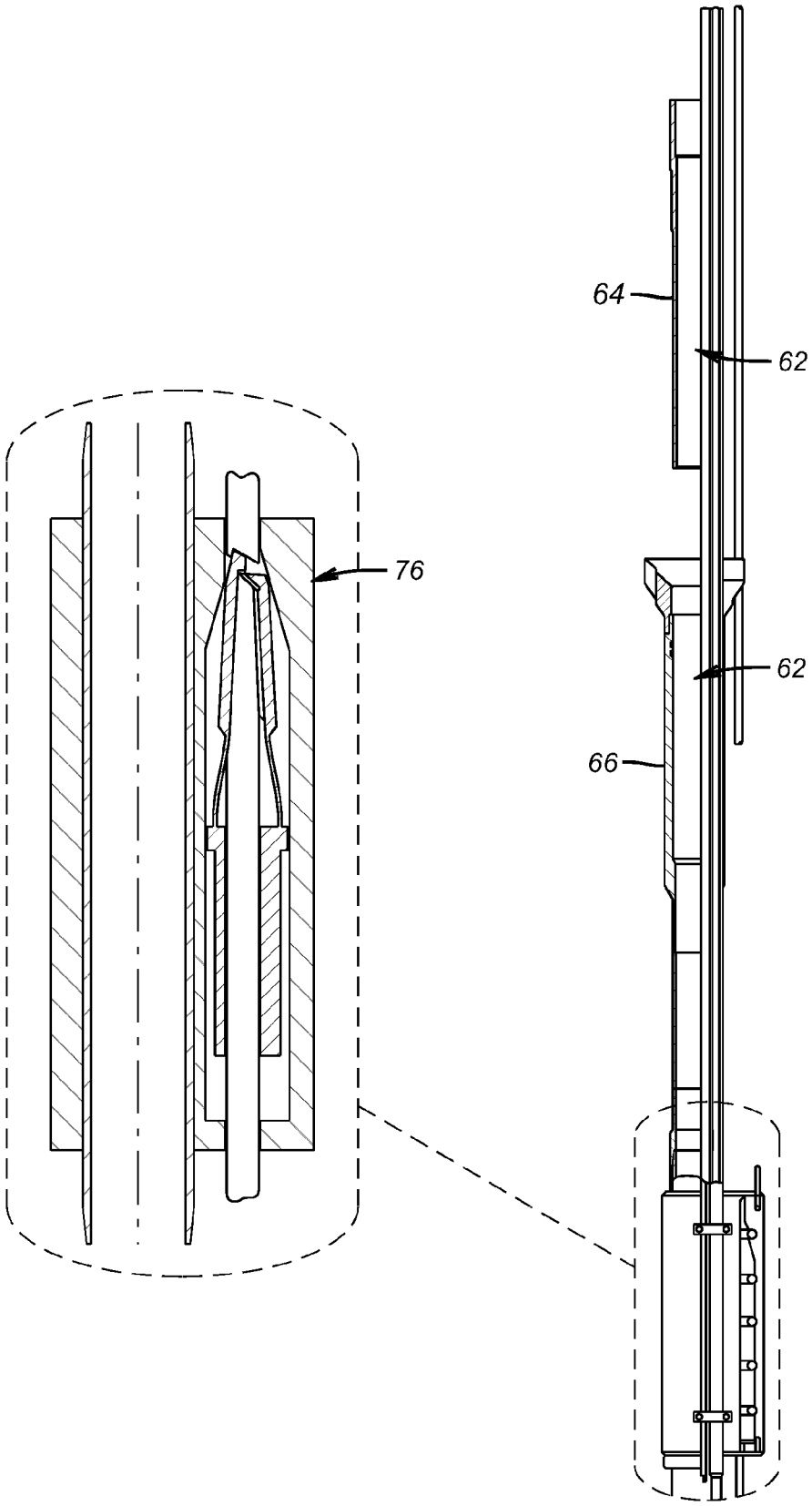
FIG. 8 is a view of the apparatus shown in FIG. 7 showing the breakaway separated and the cutter knives actuated.

The inset in FIG. 7 shows cutter housing 76 in more detail. Preferably, all the cutter housings are identical, but they need not be. A tubular 84, which is part of the string 60, has a housing 86 surrounding it with a through passage 88 so that the tubular 84 can go through the housing 86 and support it. The housing 86 can be supported by collars positioned on each end, or it can be supported by other means A second passage 90 has an uphole opening 92 and a downhole opening 94 to allow the conduit 72 to pass through. Contained within passage 90 is a grip assembly 96 used to hold the conduit 72 fixed relative to said grip assembly. Above the grip assembly 96 is the knife assembly 98 which has an opening allowing the conduit 72 to be fed continuously through in a direction from opening 92 toward opening 94 while allowing clearance between the knife assembly 98 and the conduit 72 to avoid damaging the conduit 72. The knife assembly 98 is designed to slide up taper 100 when there is a pull force on the conduit 72 to bring the opposed knives together to cut the conduit 72. Grip assembly 96 moves in tandem with knife assembly 98 by virtue of connecting links 102. When the breakaway 62 separates, the lower ends of the conduits, such as 72 remain fixed to the BHA, not shown. Continuously pulling on the string 60 will take out any slack and put tension on all the conduits such as 72 and 74 either at the same time or at delayed time intervals and forces the opposed knives in the knife assembly 98 to come together to cut every conduit, such as 72 and 74, at the same time or at different times. The grip assembly 96 holds on to the lower conduit just cut, such as 72, so that it cannot come out of the lower opening 94 and obstruct the wellbore. After the conduit, such as 72, is cut, the upper portion of the cut conduit, such as 72, will be pulled away from the cutter housing 76 through opening 92. This is shown in FIG. 8 with the breakaway 62 apart and the upper portion 64 at a distance from the fixed lower portion 66.

FIG. 9 shows that a cover 104 is secured with fasteners 106 to secure the grip assembly 96 and the knife assembly 98 in chamber 90 and allow movability such that when a pull force is applied to the conduit, such as 72, as in the case of FIG. 9, The movement of the knife assembly 98 will cut the conduit 72 while the grip assembly 96 will move with the conduit 72 until the prescribed cut is made, at which point it will slide back in chamber 90 while retaining the conduit 72 and preventing it from coming out of opening 94, which has remained stationary during the cutting operation.

Those skilled in the art will appreciate that using a breakaway 62 above the cutter housings 76, 80 allows the removal of the upper string 60 to be used to apply tension to the conduits, such as 72, 74 whose lower extensions 78, 82 are fixed by attachment at the BHA, not shown. Applied tension on the conduit 72 advances knife assembly 98 in chamber 90 and actuates the knife assembly 98 to cut said conduit 72. The lower remnants of conduit 72, after the cut, are retained in chamber 90 by the grip assembly 96. While a single conduit is shown to be cut and retained in a dedicated housing, those skilled in the art will appreciate that a single housing can cut multiple conduits. While it is preferred that the workings of the assemblies in the housings 76 and 80 are identical, variations among them can be made to suit the need of the specific conduit that needs to be cut in a given housing. The breakaway 62 can be actuated with a variety of mechanical movements of string 60 that break shear fasteners, for example, or it can be hydraulically actuated with a sleeve that can be shifted with fluid pressure to break a fastener that holds the breakaway 62 together and can thereafter be blown through as a ball on seat assembly or the ball can be blown through the seat to the BHA. The end result of the invention is that the string 60 can be quickly separated and there are no cut conduit remnants that can fall in the wellbore and obstruct it to make subsequent fishing or other operations more difficult.

The above description is illustrative of the preferred embodiment and many modifications may be made by those skilled in the art without departing from the invention whose scope is to be determined from the literal and equivalent scope of the claims below.

We claim:

1. A tubular string assembly for deployment to a subterranean location accessible from a surface, comprising:

a tubular string having at least one external conduit extending alongside, said conduit being retained at a predetermined location to said string;

said conduit extending through at least one enclosed cutter housing supported by said string;

a breakaway in said string located closer to the surface than said cutter housing, whereupon during actuation of said breakaway to separate said string into an upper and lower portion, upper portion movement actuates cutting of said conduit in said cutter housing;

movement of said conduit in tandem with said upper portion with said lower portion stationary cams a cutter located within said cutter housing to cut said conduit;

a portion of said conduit is retained against falling out of said cutter housing by a retainer located within said cutter housing that encircles said conduit.

2. The assembly of claim 1, wherein:

said upper portion pulls tension of said conduit when moved away from said lower portion.

3. The assembly of claim 1, wherein:

movement of said conduit with respect to said cutter housing cuts said conduit.

4. The assembly of claim 3, wherein:

said retainer is movably mounted in said housing.

5. The assembly of claim 4, wherein:

said housing limits movement of said retainer.

6. The assembly of claim 5, wherein:

said cutter comprises opposed knives that are moved to cut said conduit when said conduit moves said knives along a tapered surface.

7. The assembly of claim 6, wherein:

said cutter comprises a retainer for said conduit that moves in tandem with said knives when an axial force is applied to said conduit.

8. The assembly of claim 7, wherein:

said breakaway comprises nested tubulars in said string sealingly held together with a breakable member.

9. The assembly of claim 8, wherein:

said nested tubulars are separated with a mechanical force delivered through said string.

10. The assembly of claim 8, wherein:

said nested tubulars are separated with fluid pressure delivered through said string.

11. The assembly of claim 10, wherein:

said at least one conduit comprises a plurality of conduits and said at least one cutter housing comprises a plurality of cutter housings with one conduit passing through a unique housing where it can be cut.

12. The assembly of claim 11, wherein:

one conduit extends through a cutter housing where it will be cut and another housing where it will not be cut.

13. The assembly of claim 1, wherein:

said breakaway comprises nested tubulars in said string sealingly held together with a breakable member.

14. The assembly of claim 13, wherein:

said nested tubulars are separated with a mechanical force delivered through said string.

15. The assembly of claim 13, wherein:

said nested tubulars are separated with fluid pressure delivered through said string.

16. The assembly of claim 13, wherein:

said nested tubulars are located below the surface in a substantially vertical orientation.

17. The assembly of claim 13, wherein:

said nested tubulars are located below the surface in an inclined or non-vertical orientation.

18. The assembly of claim 1, wherein:

said at least one conduit comprises a plurality of conduits passing through a common cutter housing.

19. The assembly of claim 1, wherein:

said at least one conduit comprises a plurality of conduits and said at least one cutter housing comprises a plurality of cutter housings with one conduit passing through a unique housing where it can be cut.

20. The assembly of claim 19, wherein:

one conduit extends through a cutter housing where it will be cut and another housing where it will not be cut.

21. The assembly of claim 1, wherein:

said breakaway further comprises a guide for said conduit.

22. A tubular string assembly for deployment to a subterranean location accessible from a surface, comprising:

a tubular string having at least one external conduit extending alongside, said conduit being retained at a predetermined location to said string;

said conduit extending through at least one cutter housing supported by said string;

a breakaway in said string located closer to the surface than said cutter housing, whereupon during actuation of said breakaway to separate said string into an upper and lower portion, upper portion movement actuates cutting of said conduit in said cutter housing;

said at least one conduit comprises a plurality of conduits passing through a common cutter housing;

at least one conduit is positioned to be cut in said common cutter housing and another conduit is positioned where it will not be cut by said common cutter housing.

* * * * *